US005535942A

United States Patent [19]

Vilona

[11] Patent Number: 5,535,942

[45] Date of Patent: Jul. 16, 1996

[54] STACKABLE TRAY

[75] Inventor: James Vilona, Kalamazoo, Mich.

[73] Assignee: Green Bay Packaging, Inc., Green Bay, Wis.

[21] Appl. No.: 422,821

[22] Filed: Apr. 17, 1995

[51] Int. Cl.[6] ..... B65D 21/02

[52] U.S. Cl. ..... 229/199; 229/23 R; 229/178; 229/919; 493/89; 493/136

[58] Field of Search ..... 229/23 R, 166, 229/178, 199, 915, 919; 493/89, 136, 137, 140, 390, 906, 907

[56] References Cited

U.S. PATENT DOCUMENTS

| | | | |
|---|---|---|---|
| 2,105,179 | 1/1938 | Best et al. | 229/199 |
| 2,757,853 | 8/1956 | Main . | |
| 3,580,475 | 5/1971 | Mobley | 229/915 |
| 3,887,126 | 6/1975 | Wilson | 229/178 |
| 3,910,484 | 10/1975 | Wozniacki | 229/178 |
| 4,058,249 | 11/1977 | Buck . | |
| 4,101,048 | 7/1978 | Rieben et al. . | |
| 4,164,315 | 8/1979 | Pennanen . | |
| 4,175,691 | 11/1979 | Cornell et al. | 229/915 |
| 4,266,714 | 5/1981 | Crane . | |
| 4,304,351 | 12/1981 | Stollberg | 229/915 |
| 4,353,496 | 10/1982 | Nelson, Jr. et al. . | |
| 4,720,013 | 1/1988 | Nichols et al. | 229/915 |
| 4,787,553 | 11/1988 | Hoskins | 229/915 |
| 4,911,356 | 3/1990 | Townsend et al. | 229/18 |
| 4,919,267 | 4/1990 | Stoll . | |
| 5,028,000 | 7/1991 | Chabot et al. | 229/178 |
| 5,125,568 | 6/1992 | Bauer . | |
| 5,203,494 | 4/1993 | Blomfield . | |
| 5,361,976 | 11/1994 | Blomfield . | |

FOREIGN PATENT DOCUMENTS

| | | | |
|---|---|---|---|
| 1399652 | 7/1975 | United Kingdom | 229/919 |

*Primary Examiner*—Gary E. Elkins
*Attorney, Agent, or Firm*—Andrus Sceales Starke & Sawall

[57] ABSTRACT

A stackable tray is constructed of a bottom wall, a pair of end walls extending upwardly from the bottom wall, and a pair of side walls extending upwardly from the bottom wall and between the end walls. The end and side walls are preferably divergent in an upward direction. A pair of stacking support walls extend upwardly relative to the bottom wall, and are spaced slightly inwardly from the tray end walls. The stacking support walls are interconnected with the tray side walls. The side walls and stacking support walls are constructed of folded panels, and tabs are formed on the stacking support walls and on inner panels of the side walls, and the tabs of the stacking support walls and side walls function to interconnect the stacking support walls with the side walls upon folding of the stacking support wall panels and the side wall panels.

17 Claims, 3 Drawing Sheets

FIG. 4
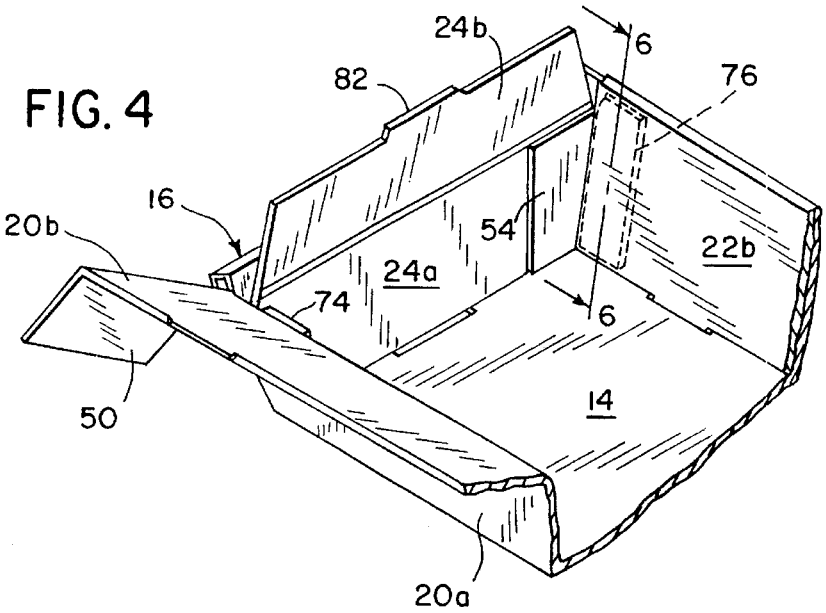
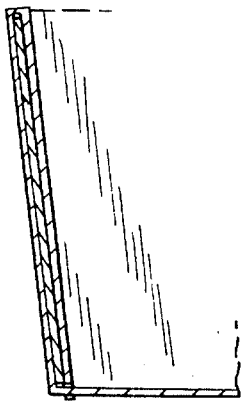
FIG. 6
FIG. 5
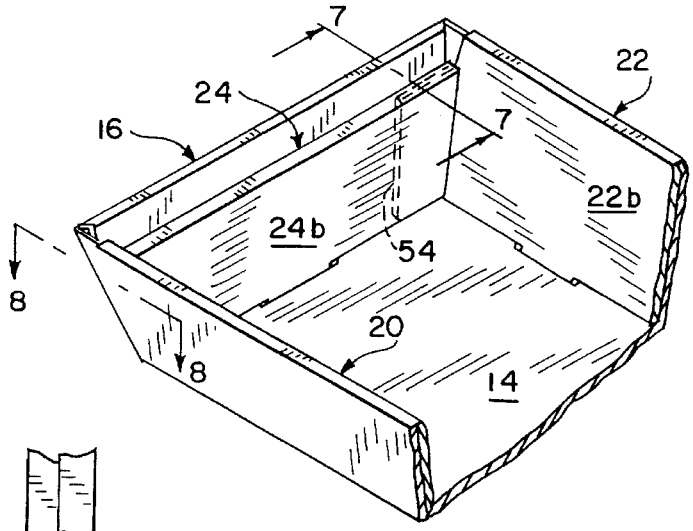
FIG. 7
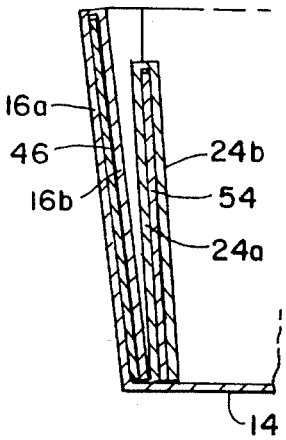
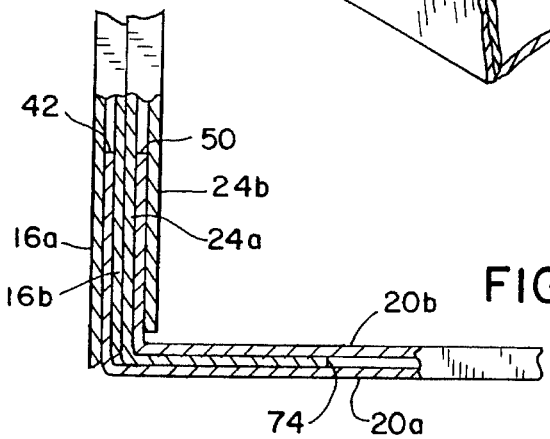
FIG. 8

STACKABLE TRAY

BACKGROUND AND SUMMARY OF THE INVENTION

This invention relates to a tray construction, and more particularly to a tray having a feature enabling multiple trays of similar construction to be stacked on top of each other.

Stacking trays are often used to facilitate handling of multiple numbers of small objects in many environments. In the past, stacking trays have been relatively expensive, primarily due to the materials used to form such trays, e.g. molded or vacuum-formed plastics, fiber board, expandable molded plastics, metal, wood or other wood fiber-related materials.

It is an object of the present invention to provide a stackable tray having a unique construction enabling the tray to be formed of a relatively inexpensive material, such as corrugated board. It is a further object of the invention to provide such a stackable tray which has significant strength and multiple-use shelf life, and which is durable enough to allow the tray to be moved, handled and conveyed by automated equipment. Yet another object of the invention is to provide such a tray construction which is relatively simple in its manufacture and construction, yet which provides highly advantageous operating and use characteristics.

In accordance with one aspect of the invention, a tray is formed of a bottom, first and second spaced end walls extending upwardly from the bottom, and first and second spaced side walls extending upwardly from the bottom and between the end walls. The tray includes first and second stacking support walls spaced inwardly from the first and second end walls, respectively, with each support wall extending upwardly relative to the bottom wall and defining an upper edge. Each stacking support wall defines a pair of spaced end portions, with each end portion being interconnected with one of the side walls for securing the stacking support walls in position. The upper edges defined by the stacking support walls are adapted to engage the bottom of a similarly constructed tray placed thereabove, so as to enable multiple trays to be stacked. Preferably, the upper edges of the stacking support walls are located below the upper edges of the end walls and/or side walls, so as to prevent the stacked trays from shifting relative to each other. Each stacking support wall is preferably formed by a pair of panels which, in a preferred construction, are foldably interconnected with each other such that the fold therebetween defines the upper edge of the stacking support wall. Each side wall is formed so as to include a tab which extends toward the opposite side wall, and which is received between the pair of panels making up the stacking support wall. This functions to securely interconnect the stacking support wall with the side walls. The side wall tabs are preferably placed between the stacking support wall panels prior to folding of the stacking support wall panels, such that movement of the stacking support wall panels to their folded position captures the side wall tabs between the stacking support wall panels.

In addition, each side wall is preferably formed from a pair of panels, which are preferably foldably interconnected with each other. Each end of the stacking support wall is provided with an outwardly extending tab, which is received between the side wall panels so as to further interconnect the stacking support wall with each side wall. Again, the stacking support wall tab is preferably positioned between the side wall panels before the side wall panels are folded together, so that movement of the side wall panels to their folded position captures and secures the stacking support wall tab therebetween.

The stacking support wall is further interconnected with the bottom of the tray by means of a tab formed in a lower edge defined by the stacking support wall, which is received within a slot formed in the bottom of the tray. In addition, the end wall of the tray is preferably constructed of a pair of foldably interconnected panels, with an inner one of the end wall panels defining a tab which is also received within the same slot as the stacking support wall tab. The end wall is preferably constructed so as to angle away from the stacking support wall in an upward direction, and a hand hole is formed in the end wall. The angle of the end wall defines a space between the end wall and the stacking support wall, to receive a user's fingers when grasping the hand hole.

The invention further contemplates a method of making a stackable tray, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIGS. 3–5 are isometric views of an end portion of the tray of FIG. 1, showing the manner in which the stacking support wall is interconnected with the tray side walls and bottom wall;

FIG. 6 is a partial section view taken along line 6—6 of FIG. 4;

FIG. 7 is a partial section view taken along line 7—7 of FIG. 5;

FIG. 8 is a partial section view taken along line 8—8 of FIG. 7;

DETAILED DESCRIPTION OF THE INVENTION

Figure 1:
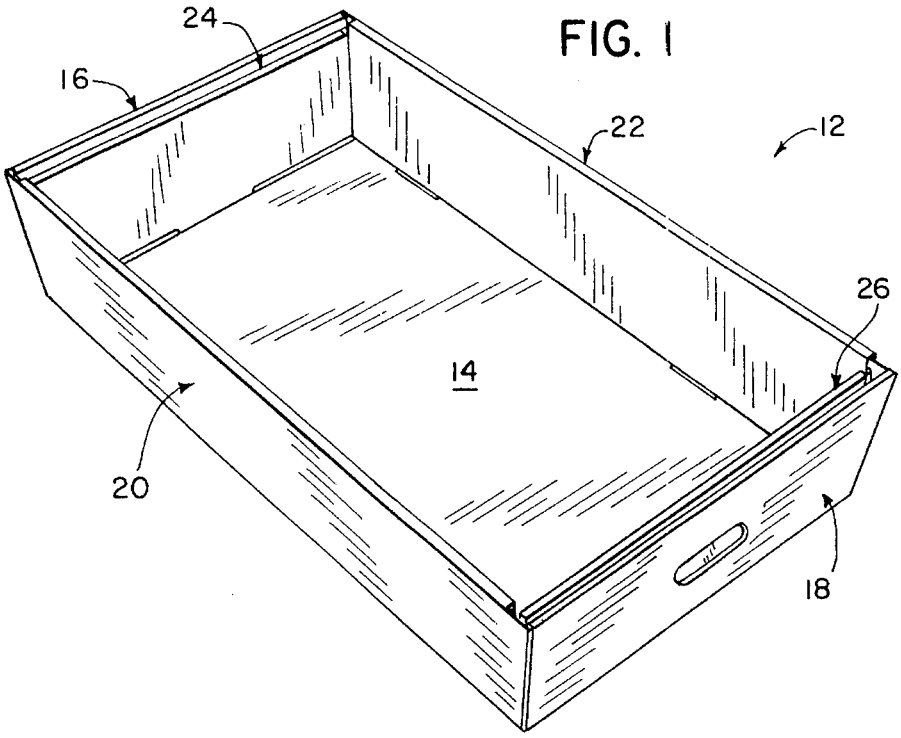
FIG. 1 is an isometric view of a stackable tray constructed according to the invention.

Referring to FIG. 1, a stackable tray 12 generally includes a bottom wall or panel 14, a pair of end walls 16, 18 extending upwardly from the ends of bottom wall 14, and a pair of side walls 20, 22 extending upwardly from the sides of bottom wall 14 and extending between the ends of end walls 16, 18. A pair of stacking support walls 24, 26 extend between side walls 20, 22 adjacent end walls 16, 18, respectively. This construction of tray 12 defines an upwardly facing cavity defined by bottom wall 14 in combination with side walls 20, 22 and stacking support walls 24, 26.

Figure 2:
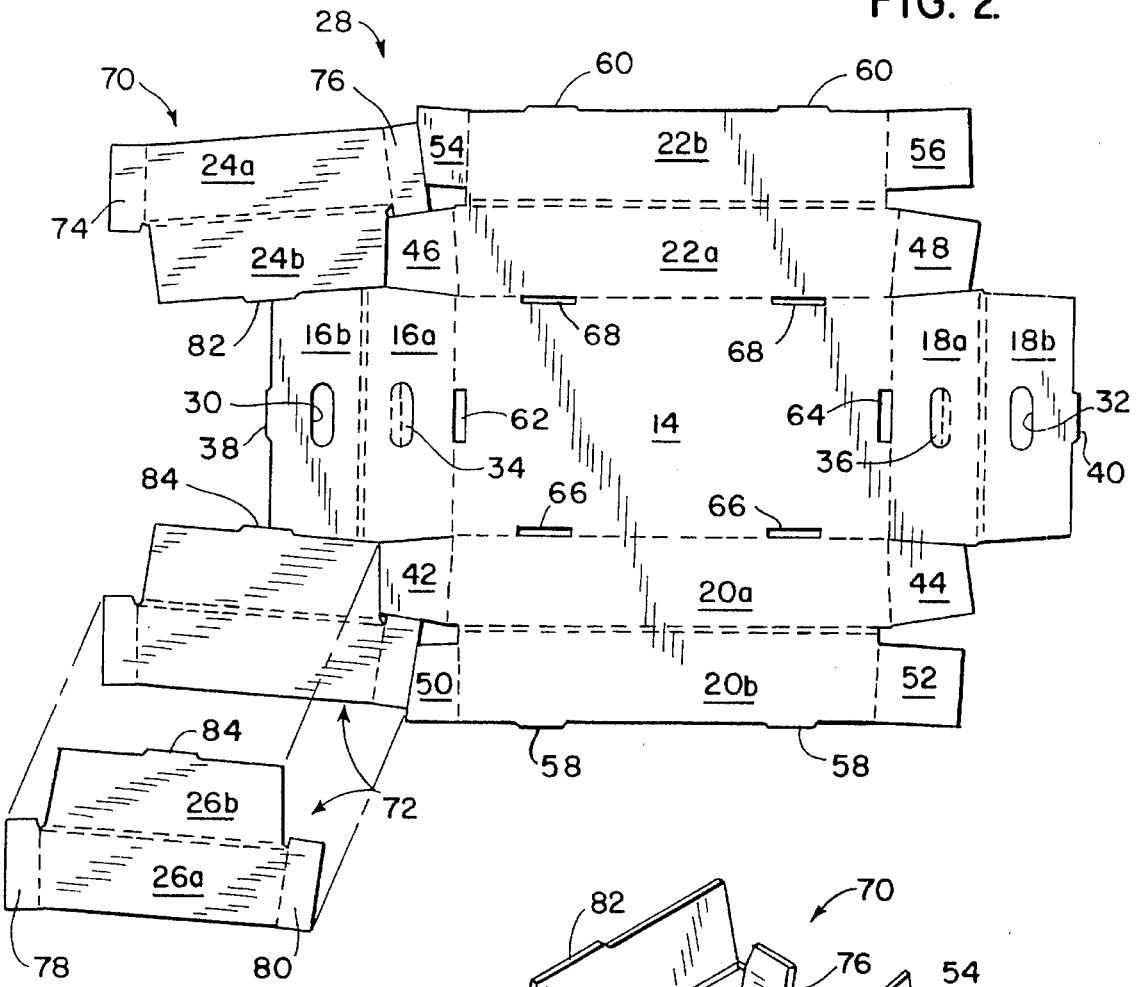
FIG. 2 is a plan view of a blank from which the tray of FIG. 1 is constructed.

Referring to FIG. 2, tray 12 is constructed from a blank 28, which is preferably formed of a corrugated paperboard material and which is die cut in accordance with conventional known technology. In FIG. 2, dashed internal lines represent perforations, and solid internal lines represent slits or scores through the corrugated material of blank 28.

Blank 28 is scored and slit so as to define the various panels used to construct walls 14–26 of stacking tray 12. Bottom wall 14 is located in the central portion of blank 28, and outer end wall panels 16*a*, 18*a* are located along the short edges of bottom wall 14, with a perforation being located between bottom wall 14 and outer end wall panels 16*a*, 18*a*. Inner end wall panels 16*b*, 18*b* are located adjacent outer end wall panels 16*a*, 18*a*, respectively, with a double perforation being formed between the respective inner and outer panels. Oval hand-hole cutouts 30, 32 are formed in inner end wall panels 16*b*, 18*b*, respectively. Hinged hand-hole flaps 34, 36 are formed in end wall outer panels 16*a*, 18*a*, respectively, with each being provided with a central longitudinal perforation. Central tabs 38, 40 are formed on the outer edges of end wall inner panels 16*b*, 18*b*, respectively.

Side wall outer panels 20*a*, 22*a* are formed along the long edges of bottom wall 14, with each being separated from bottom 14 by a perforation. Side wall outer panels 20*b*, 22*b* are located adjacent side wall inner panels 20*a*, 22*a*, respectively, with a double perforation being located between the respective outer and inner panels. End wall tabs 42, 44 extend from the opposite ends of side wall outer panel 20*a*, and end wall tabs 46, 48 extend from the opposite ends of side wall outer panel 22*a*. Stacking support wall tabs 50, 52 extend from the opposite ends of side wall inner panel 20*b*, and stacking support wall tabs 54, 56 extend from the opposite ends of side wall inner panel 22*b*. A pair of locking tabs 58 are formed along the outer edge of side wall inner panel 20*b*, and a pair of locking tabs 60 are formed along the outer edge of side wall inner panel 22*b*.

Central end slots 62, 64 are formed in the ends of bottom wall 14 such that the outermost edge of each of slots 62, 64 is coincident with the perforation separating end wall outer panels 16*a*, 16*b*, respectively, from bottom wall 14. Similarly, a pair of side slots 66 and a pair of side slots 68 are formed along the sides of bottom wall 14, with the outer edges of slots 66, 68 being coincident with the perforation separating bottom wall 14 from side wall outer panels 20*a*, 22*a*, respectively.

Blank 28 further includes a pair of stacking support blanks 70, 72 which are separable from the components of blank 28 described above. Stacking support blanks 70, 72 form stacking support walls 24, 26, respectively, when interconnected with the side walls of tray 12, in a manner to be explained. Stacking support blank 70 defines an outer panel 24*a* and an inner panel 24*b*, and stacking support blank 72 defines an outer panel 26*a* and an inner panel 26*b*. Double perforations separate outer stacking support panels 24*a*, 26*a* from inner stacking support panels 24*b*, 26*b*, respectively. A pair of side wall tabs 74, 76 extend from the opposite ends of stacking support outer panel 24*a*, and a pair of side wall tabs 78, 80 extend from the opposite ends of stacking support outer panel 26*a*. A central tab 82 is formed along the outer edge of stacking support inner panel 24*b*, and a central tab 84 is formed along the outer edge of stacking support inner panel 26*b*.

Figure 3:
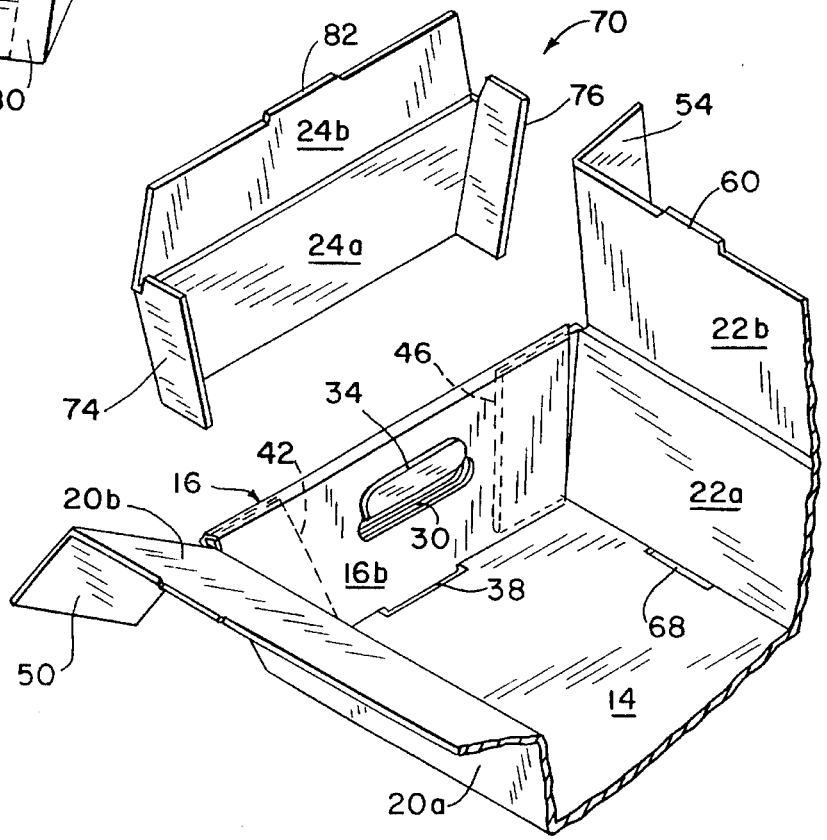

Tray 12 is constructed as follows. First, stacking support blanks 70, 72 are separated from the body of blank 28 as shown in FIG. 2. Thereafter, end walls 16, 18 are constructed by folding outer end wall panels 16*a*, 18*a* upwardly about the perforation between each panel and a bottom wall 14, and thereafter folding inner end wall panels 16*b*, 18*b* downwardly toward each other about the double perforation between each end wall inner panel and its associated outer panel. Outer side wall panels 20*a*, 22*a* are then folded upwardly about the perforation between each panel and bottom wall 14. End wall tabs 42, 46 are folded toward each other so as to be disposed against the inner surface of outer end wall panel 16*a*, and end wall tabs 44, 48 are folded toward each other and placed against the inner surface of outer end wall panel 18*a*. Inner end wall panels 16*b* and 18*b* are then folded downwardly to engage tabs 38, 40 within bottom wall end slots 62, 64, respectively. The end result of these steps is as shown in FIG. 3 with respect to end wall 16, and illustrates the manner in which end wall tabs 42, 46 of side wall outer panels 20*a*, 22*a*, respectively, are sandwiched between end wall panels 16*a* and 16*b*. The same steps are carried out for end wall 18, so that end walls 16, 18 are fully constructed. Flaps 34 and 36 are then folded inwardly and pushed through openings 30, 32, respectively, to form a hand grip in each of end walls 16, 18.

While tray 12 is partially constructed as shown in FIG. 3, stacking support wall blanks 70, 72 are engaged with tray 12. The securing of stacking support wall blank 70 with tray 12 adjacent end wall 16 will be described with reference to FIGS. 3–5, with the understanding that such description applies equally to the manner in which stacking support wall blank 72 is secured to tray 12 adjacent end wall 18.

Stacking support wall blank 70 is first moved from its FIG. 3 position, in which its side wall tabs 74, 76 are folded toward end wall 18, to an assembly position in which the lower edges of support wall outer panel 24*a* and tabs 74, 76 engage bottom wall 14. In this position, tabs 74, 76 are placed against side wall outer panels 20*a*, 22*a*, respectively. Inner side wall panels 20*b* and 22*b* are then folded downwardly toward bottom panel 14, so as to capture side wall tabs 74, 76, respectively, within a space between outer and inner side wall panels 20*a*, 20*b* and 22*a*, 22*b*, respectively, to sandwich tabs 74, 76 therebetween and to interconnect stacking support wall 24 with side walls 20, 22. As shown in FIG. 4, this functions to place stacking support wall tabs 50 and 54 of side wall inner panels 20*b*, 22*b*, respectively, against stacking support wall outer panel 24*a*. Stacking support wall inner panel 24*b* is then folded about the double perforation between panels 24*a* and 24*b*, and locking tab 82 is then engaged within bottom wall end slot 62, as shown in FIG. 5. This functions to capture tabs 50, 54 within the space between outer and inner stacking support wall panels 24*a*, 24*b*, to sandwich the tabs therebetween and to further interconnect stacking support wall 24 with tray side walls 20, 22.

When tray 12 is fully constructed, end walls 16, 18 are each angled away from each other in a bottom-to-top direction, as are side walls 20, 22. Stacking support walls 24, 26 are oriented vertically and are perpendicular to bottom wall 14.

Stacking support walls 24, 26 are constructed such that the upper extent of each is disposed below the upper edge of adjacent end walls 16, 18, respectively. The outwardly divergent angle of end walls 16, 18 relative to stacking support walls 24, 26, respectively, provides a space to receive a user's fingers when grasping end walls 16, 18 via the hand holes formed therein.

End wall slots 62, 64 have a width adapted to receive and tightly engage locking tabs 38, 82 and 40, 84, respectively. This construction functions to securely maintain stacking support walls 24, 26 in engagement with side walls 20, 22 by maintaining stacking support inner panels 16*b*, 18*b* in their folded position.

Tabs 42–48, 50–56 and 74–80 are constructed such that each tab has a height substantially equal to that of the space in which the tab is received, to securely interlock end walls 16, 18, side walls 20, 22 and stacking support walls 24, 26 together. Further, the perforation at which each tab is folded is angled to accommodate the angle of the wall within which the tab is engaged.

Figure 9:
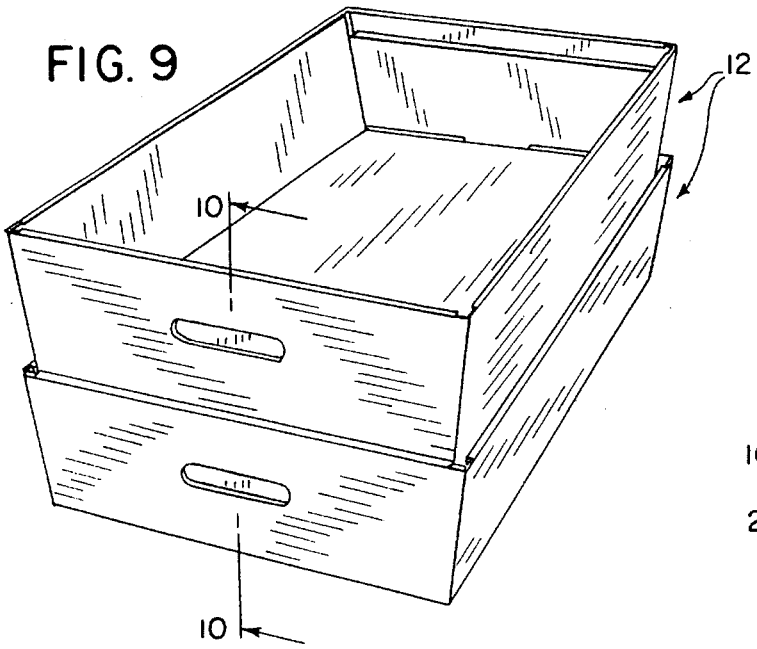
FIG. 9 is an isometric view of a pair of the trays of FIG. 1 in a stacked position.
Figure 10:
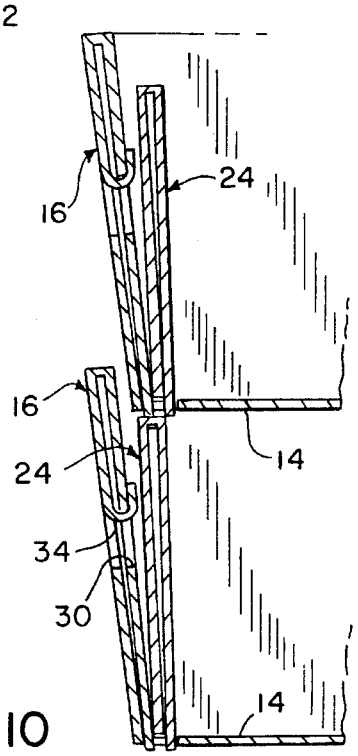
FIG. 10 is a partial section view taken along line 10—10 of FIG. 9.

Referring to FIGS. 9 and 10, a pair of trays 12, constructed as shown in FIGS. 1–8 and described above, are shown stacked one on top of the other. The upper edges of stacking support walls 24, 26 of the lower tray 12 engage the lower surface of bottom wall 14 of the upper tray 12, so as to enable the trays to be stacked without the upper tray engaging the contents of the lower tray. The outward flare or divergence of end walls 16, 18 and side walls 20, 22 ensures that the end and side walls of the stacked trays do not engage each other when the trays are stacked. As can be appreciated, a large number of similarly constructed trays can be stacked on top of each other, due to the strength and construction of stacking support walls 24, 26, which resist buckling when loaded and which are capable of carrying substantial loads.

It can thus be appreciated that the invention provides a stacking tray which can be constructed from a single blank of material and which can easily be converted from a flat, unassembled condition (typically as shipped to the customer) to a fully constructed and assembled condition without the need for adhesives or fasteners, simply by carrying out a relatively small number of folding and connecting operations as described. While the tray is preferably constructed of a material such as corrugated paperboard so as to provide adequate sufficient strength and stiffness characteristics at a relatively low cost, it is contemplated that other materials could be used as desired according to cost, durability and other factors as dictated by the end user.

Various alternatives and embodiments are contemplated as being within the scope of the following claims particularly pointing out and distinctly claiming the subject matter regarded as the invention.

I claim:

1. A tray construction, comprising:

a bottom;

first and second spaced end walls extending upwardly from the bottom, each end wall defining an upper edge;

first and second spaced side walls extending upwardly from the bottom and extending between the end walls; and first and second stacking support walls extending upwardly relative to the bottom wall and spaced inwardly from the first and second end walls, respectively, wherein each of the first and second stacking support walls defines spaced end portions, each end portion being interconnected with one of the first and second spaced side walls.

2. The tray construction of claim 1, wherein each stacking support wall includes a pair of panels defining a space therebetween, and wherein each of the side walls includes an end tab, and wherein the stacking support wall end portions are interconnected with the side walls by engagement of the side wall end tabs within the space between the pair of stacking support wall panels.

3. The tray construction of claim 2, wherein each side wall is defined by a pair of panels defining a space therebetween, and wherein each stacking support wall end portion defines a tab received within the space defined by the pair of side wall panels.

4. The tray construction of claim 1, wherein each stacking support wall is further interconnected with the bottom.

5. The tray construction of claim 4, wherein the stacking support wall includes a pair of panels, with a first one of the panels defining a locking tab, and wherein the bottom includes a slot, wherein the stacking support wall is interconnected with the bottom by engagement of the locking tab within the slot.

6. The tray construction of claim 5, wherein each side wall includes an end tab, and wherein the side wall end tabs are disposed between the stacking support wall panels.

7. A method of making a stackable tray, comprising the steps of:

providing a tray having a bottom, a pair of end walls and a pair of side walls; and securing a stacking support inwardly of each end wall, each stacking support defining a pair of spaced end portions, by interconnecting each end portion of the stacking support with one of the side walls.

8. The method of claim 7, wherein each stacking support is defined by a pair of panels having a space therebetween, and wherein the step of interconnecting each end portion of the stacking support with one of the side walls is carried out by forming an end tab on each side wall and positioning the side wall end tab within the space defined by the pair of stacking support panels.

9. The method of claim 8, wherein the step of forming an end tab on each side wall is carried out by forming the side wall of a pair of panels and constructing an inner one of the panels so as to define the end tab.

10. The method of claim 7, wherein each side wall is formed by a pair of panels defining a space therebetween, and wherein the step of interconnecting each end portion of the stacking support with one of the side walls comprises forming an end tab extending from each end portion of the stacking support and placing the end tab within the space defined between the pair of side wall panels.

11. The method of claim 10, wherein the pair of side wall panels are foldably interconnected, and wherein the step of placing the stacking support end tab within the space between the pair of side wall panels is carried out by placing the end tab against an outer one of the side wall panels and thereafter folding an inner one of the side wall panels onto and toward the outer side wall panel so as to capture the stacking support end tab therebetween.

12. In a tray construction including a bottom, an end wall defining an upper edge, and a pair of side walls, the improvement comprising a support wall extending upwardly relative to the bottom and spaced from the end wall, the support wall being interconnected with the side walls and defining an upper support edge spaced below the end wall upper edge.

13. The improvement of claim 12, wherein the support wall defines first and second spaced end portions, and wherein each support wall end portion is interconnected with one of the side walls.

14. The improvement of claim 13, wherein each end portion of the support wall defines an end tab, and wherein each side wall is formed from a pair of panels defining a space therebetween within which the end tab is located so as to interconnect the support wall end portion with the side wall.

15. The improvement of claim 13, wherein the support wall is defined by a pair of panels, and wherein each side wall includes a tab disposed between the support wall panels for interconnecting each support wall end portion with one of the side walls.

16. The improvement of claim 15, further comprising a downwardly extending locking tab formed along a lower edge of one of the support wall panels, and a slot formed in the bottom within which the tab is engaged for interconnecting the support wall with the bottom.

17. The improvement of claim 16, wherein the end wall is formed of a pair of folded panels, wherein an inner one of the end wall panels includes a tab formed in a lower edge thereof received within the slot along with the support wall locking tab.

* * * * *